US007537406B2

(12) United States Patent
Kurek et al.

(10) Patent No.: US 7,537,406 B2
(45) Date of Patent: May 26, 2009

(54) DEVICE FOR STORING AND DISPENSING COSMETIC COMPOSITIONS

(75) Inventors: John S. Kurek, Goshen, NY (US); William E. McNamara, Middletown, NY (US); Ralph DeVito, Oxford, CT (US); David Chastain, Boston, MA (US); Tonia Giesecke, Brighton, MA (US)

(73) Assignee: Avon Products, Inc, New York, NY (US)

( * ) Notice: Subject to any disclaimer, the term of this patent is extended or adjusted under 35 U.S.C. 154(b) by 205 days.

(21) Appl. No.: 11/703,940

(22) Filed: Feb. 8, 2007

(65) Prior Publication Data

US 2007/0158372 A1 Jul. 12, 2007

(51) Int. Cl.
*B43K 5/06* (2006.01)
*B43K 7/12* (2006.01)
*A46B 11/00* (2006.01)

(52) U.S. Cl. ..... 401/172; 401/124; 401/129

(58) Field of Classification Search ..... 401/122–124, 401/129, 172–175, 126, 127, 143, 277; 222/320, 222/321.6–321.9; 239/333
See application file for complete search history.

(56) References Cited

U.S. PATENT DOCUMENTS

| | | | | |
|---|---|---|---|---|
| 3,400,997 | A | 9/1968 | Schwartzman | |
| 5,372,444 | A * | 12/1994 | Lhuisset | 401/175 |
| 5,678,941 | A | 10/1997 | Nakajima | |
| 6,142,692 | A * | 11/2000 | Garcia | 401/122 |
| 6,305,863 | B1 | 10/2001 | Gueret | |
| 6,503,013 | B2 | 1/2003 | Strauss | |
| 2004/0126345 | A1 | 7/2004 | McNamara et al. | |
| 2006/0088486 | A1 | 4/2006 | McNamara et al. | |
| 2006/0147399 | A1 | 7/2006 | McNamara et al. | |

* cited by examiner

*Primary Examiner*—Tuan N Nguyen
(74) *Attorney, Agent, or Firm*—Charles J. Zeller; Joan M. McGillycuddy; Anthony M. Santini

(57) ABSTRACT

A drive screw having an axial bore is disposed within a tubular container. A cap for closing the container has mounted therefrom an applicator that is insertable in the bore of the drive screw. A first seal and a second seal, on the drive screw, form with the inner wall of the container and the outer wall of the drive screw an annular compartment for housing a cosmetic composition. A normally closed channel is provided between the compartment and the bore of the drive screw. A drive on the cap and a complementary drive on the drive screw cooperate with the first seal and the second seal to decrease the volume of the compartment in which the composition is housed each time the container is opened by removing the cap. A valve opens the channel in response to the decrease in volume in the compartment when the cap is removed so as to permit composition to flow through the channel into the bore of the drive screw to contact the applicator.

28 Claims, 6 Drawing Sheets

DEVICE FOR STORING AND DISPENSING COSMETIC COMPOSITIONS

RELATED APPLICATIONS

This application claims priority to, and the benefit of, co-pending PCT application US05/28089 filed Aug. 5, 2005, which in turn claims priority to U.S. Patent Application Ser. No. 60/599,909 filed Aug. 9, 2004.

FIELD OF THE INVENTION

The present invention relates to a cosmetic dispensing device. More particularly, it relates to a device for dispensing a mascara composition.

BACKGROUND OF THE INVENTION

Prior art containers for storing and dispensing mascara and similar cosmetic products have remained the same in design and function for several decades.

Devices for dispensing mascara compositions are known in the art. One such device comprises a tubular container, which serves as a reservoir for a mascara composition. The tubular container is open at one end. An applicator comprising a rod having bristles at one end and a cap portion at its other end is removably disposed in the container and in contact with the mascara composition in the container. Typically the rod and bristles are housed or submerged directly in the mascara composition. The cap portion serves as a closure for the open end of the tubular container. This is generally accomplished by providing the cap interior surface with threading adapted to engage threading on the exterior surface of the tubular container at its open end.

Generally, such prior art devices also include a wiper. The wiper is disposed within the tubular container. The wiper functions to remove excess mascara composition from the applicator bristles and rod when the applicator is removed from the tubular container for the purpose of applying the mascara composition to the eyelashes.

Such prior art devices have proven to be deficient in a number of respects. Typically they rely only on wiper to cap and wiper to rod contact for sealing the mascara composition contained therein from the atmosphere. As the mascara composition in the prior art container is used, the headspace (air space between the mascara composition and the side walls and top or bottom of the container) increases and the propensity for the mascara composition to dry out becomes more evident. This results in difficulty of use and shorter product life. Such devices generally permit dispensing of about 50 to 70% of the compositions contained therein. Moreover, the prior art devices repeatedly expose the bulk of the composition stored therein to the atmosphere during each use by the consumer. This serves to increase the risk of contamination by foreign substances such as particulate matter and microbes.

Moreover, such prior art devices are not suitable for storage and application of cosmetic compositions containing a significant concentration of one or more volatile agents, for example, the volatile agents contained in post-foaming mascara compositions, as described in U.S. patent application Ser. No. 10/331,069, PCT Application No. US03/40782, PCT Application No. PCT/US03/40790, and PCT Application No. PCT/US03/40789.

Heretofore, post-foaming mascara compositions containing volatiles, such as isopentane, required storage in closed containers. The present inventors' attempts to dispense such post-foaming compositions from the above described prior art devices met with failure. The prior art devices do not have the ability to contain compositions with volatile component(s) capable of generating a vapor pressure. Furthermore, prior art devices allow post-foaming or post-expanding compositions to pre-expand or foam resulting in a loss of efficacy. The compositions tended to dry out inside the devices. Each time the applicator was removed and reinserted in the prior art device air entered and caused drying of the mascara composition coating the inner surface of the reservoir housing the mascara composition. As the composition was used up, the headspace in the reservoir and the inner surface area where composition drying can occur increased. This led to further drying and loss of volatile composition components.

It is an object of the present invention to obviate the above described drawbacks of prior art mascara containers and dispensing devices.

It is a further object of the present invention to provide an improved container and dispensing mechanism wherein the cosmetic composition is housed separately from the applicator and the composition is only dosed onto the applicator, preferably, in a metered fashion.

It is another object of the present invention to provide a dispensing device in which the reservoir of unused product is kept separate from the used, contaminated or exposed composition.

It is yet another object of the present invention to provide a dispensing device in which headspace in the reservoir for the composition is substantially eliminated.

It is yet a further object of the present invention to provide a dispensing device that enables use of up to 95-99% of the composition contained therein.

It is still another object of the present invention to provide a dispensing device in which unused composition is kept from exposure to air. This is particularly important for air sensitive compositions.

An additional object of the present invention is to provide a dispensing device that enables delivery of a predetermined unit dose of composition contained therein.

SUMMARY OF THE INVENTION

The present invention provides a device for storing and packaging flowable compositions, especially cosmetic compositions, and more especially flowable cosmetic compositions that require barrier system type storage. For example, compositions that must be sealed from the outside atmosphere are suitably packaged in the device of the present invention. Such compositions include volatiles such as volatile hydrocarbon oils, volatile silicone fluids and volatile alcohols that would otherwise evaporate from the composition.

Any composition containing one or more components the stability of which is decreased when exposed to normal atmospheric conditions, for example components susceptible to oxidation, may also be stored in the package of the present invention. Examples of such compositions include, but are not limited to, skin care formulations containing actives such as retinol, tocopherol, and ascorbic acid. Upon exposure to the atmosphere (oxygen and sun light in some circumstances) such compounds oxidize into less effective or totally ineffective compounds.

Virtually any flowable (e.g. liquid, semi-solid, gel, etc.) composition that is susceptible to drying out over time may also be stored in the package of the present invention. Many ordinary cosmetic formulations are housed in containers that allow for headspace, leading to dry out. As the product is used up, more headspace is created, resulting in shorter product life. For example, prior art containers for mascara, liquid lipstick and foundation all typically allow for product dry out over time. The package device of the present invention prolongs product life by eliminating dry out and ensuring compositional consistency between the first and last dose. Thus, the packaging device of the instant invention is ideally suitable for packaging, for example, mascara, lip gloss, lip gel, concealer, foundation, eyebrow enhancer and eyeshadow compositions. Mascara compositions that may be dispensed from the dispenser disclosed herein include the pressurized or non-pressurized post-foaming mascara compositions of U.S. patent application Ser. No. 10/331,069, PCT Application No. US03/40782, PCT Application No. PCT/US03/40790, and PCT Application No. PCT/US03/40789, which applications are incorporated herein by reference.

The dispensing device for a flowable composition comprises a first compartment for containing the composition; a second compartment in fluid communication with the first compartment, the second compartment generally being adapted to contain an amount of the composition suitable for a single use; a valve in normally closed position preventing flow from the first compartment to the second compartment; a cap adapted to removably close the second compartment, and a drive assembly affixed to the cap, the drive assembly opening the valve in response to the opening of the cap, whereby composition contained in the first compartment flows into the second compartment.

In another aspect of the invention the drive assembly, in response to the removal of the cap from the device, reduces the volume of the first compartment compressing the composition therein, the increase in pressure in the first compartment opening the valve and allowing the composition to flow into the second compartment, the valve closing upon equalization of the pressure in the compartments.

In yet another aspect of the present invention a dispensing device for a flowable composition is provided comprising: a tubular container; a drive screw having an axial bore, the drive screw being disposed within the tubular container; a cap for closing the container; an applicator mounted from the cap and insertable in the bore of the drive screw; a first seal and a second seal on the drive screw, said first and second seals forming with the inner wall of the tubular container and the outer wall of the drive screw an annular compartment for housing the flowable composition, the drive screw having at least one channel providing fluid communication between the annular compartment and the bore of the drive screw; a drive associated with the cap, and a drive associated with the drive screw adapted to engage the cap drive, the drives cooperatively decreasing the volume of the compartment each time the container is opened, the second seal, which normally closes the channel, opening the channel in response to the decrease in volume in the compartment and permitting composition to flow through the channel into the axial bore of the drive screw to contact the applicator.

Another aspect of the present invention provides a dispensing device for a flowable composition, especially a cosmetic composition, comprising: a tubular container having a bottom end, a top end, an interior wall, and an externally threaded neck at the top end, the container being open at the neck; a drive screw having a top end, a bottom end, a vertically extending axial bore, and a threaded outer wall, the threading terminating at a point above the bottom end of the drive screw; a drive within the bore proximate the top end of the drive screw; a valve seat on the drive screw below the threaded outer wall and above the bottom end of the drive screw, the wall of the drive screw below the valve seat having at least one aperture, and the valve seat preferably being a radial extension on the drive screw whose diameter is greater than the diameter of the drive screw; a piston threadably mounted on the drive screw; a valve having a valve seal, the valve slideably mounted on the drive screw below the valve seat; the drive screw with the piston and the valve mounted thereon being positioned within the tubular container, the piston and the valve each forming with the interior wall of the tubular container a frictional peripheral seal, the piston and the valve defining with the interior wall of the tubular container and the outer wall of the drive screw an annular compartment for the flowable composition, the at least one aperture in the drive screw below the valve seat providing fluid communication between the annular compartment and the drive screw bore, the piston being rotatably movable downwards on the threads of the drive screw, and the valve being axially movable in a direction downwards from the valve seat; a biasing element for biasing the valve seal against the valve seat so that the at least one aperture in the wall of the drive screw is normally closed, and a cap assembly comprising a cap, a rod mounted from the cap and being removably insertable in the vertically extending axial bore of the drive screw; the rod having at least one, preferably a plurality, of ratchet teeth about its circumference and a drive adapted to complement the drive within the bore of the drive screw, the rod drive engaging the drive within the drive screw bore when the rod is within the bore of the drive screw, a cap insert mounted in the cap and having at one end internal threading that mates with the external threading on the neck of the tubular container and, at its other end, at least one, preferably a plurality, of angularly offset tabs, the at least one ratchet teeth on the rod engaging the at least one angularly offset tabs when the rod is turned in one direction and free wheeling when the rod is turned in a direction opposite to said one direction; whereby, when the cap is threaded off the neck of the tubular container to open the dispensing device, the at least one tabs engage the at least one ratchet teeth and transfer rotational motion from the engaged complementary drives to the drive screw, the threadably mounted piston on the drive screw advancing downwards on the drive screw resulting in a decrease in volume of the annular compartment and a concomitant increase in pressure on the composition therein that overcomes the upward biasing force of the biasing element to cause the valve seal to move downwards from the valve seat to expose the at least one aperture in the wall of the drive screw and permit composition to flow from the annular compartment into the bore of the drive screw to contact the rod.

DESCRIPTION OF THE DRAWING FIGURES

The invention will now be described with reference to the drawings in which.

DETAILED DESCRIPTION OF THE INVENTION

Figure 1:
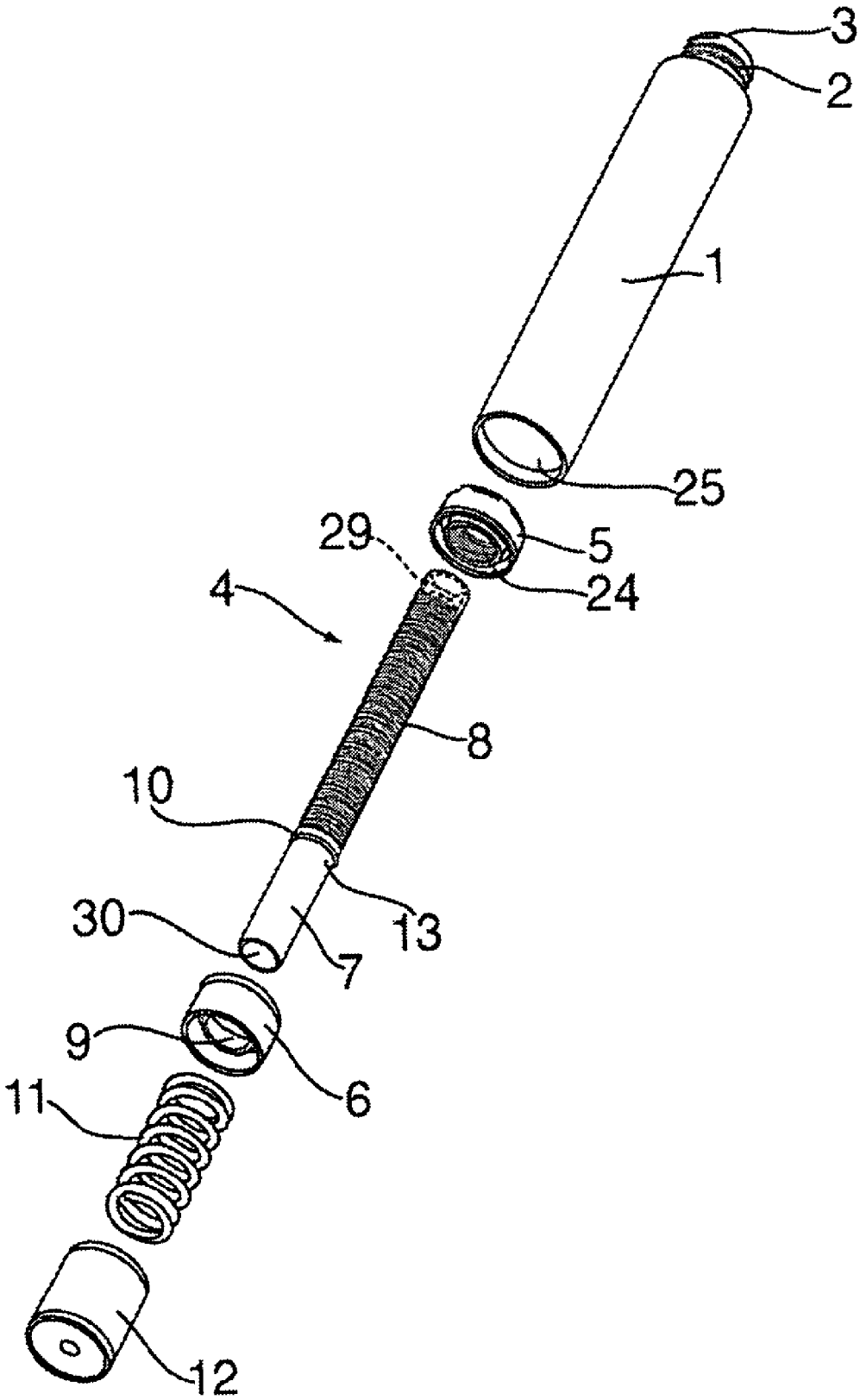
FIG. 1 is an exploded perspective view of the container, piston, drive screw, valve, spring, and end cap of a preferred embodiment of the device of the invention.

In a preferred embodiment, the device of the present invention, as shown in FIG. 1, includes a cylindrical container (1) having a predetermined inside diameter. The container has a threaded neck portion (2) and is open at one end (3). Preferably, it is also open at its other (lower) end (25) to facilitate assembly of the device and filling it with a cosmetic composition (not shown). The container (1) is preferably injection molded to control its inside diameter. An exteriorly threaded drive screw (4) having a bore (30) open at least at its upper end is disposed inside the container along the container's central vertical axis. As used herein the term "upper" is intended to mean that end or portion of the device, or the end or portion of any component part of the device, proximate to, towards, or in the direction of cap (14) (see FIG. 3). The term "lower" is intended to mean that end or portion of the device, or the end or portion of any component part of the device, proximate to, towards, or in the direction of end cap (12). The drive screw (4) is preferably hollow through its entire length, as shown in FIG. 1.

Figure 1A:
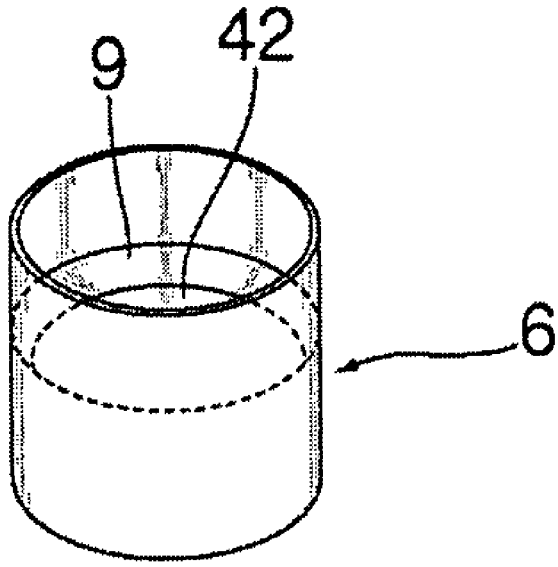
FIG. 1A is an enlarged view of valve (6) shown in FIG. 1 illustrating with greater detail the interior top portion thereof.
Figure 1B:
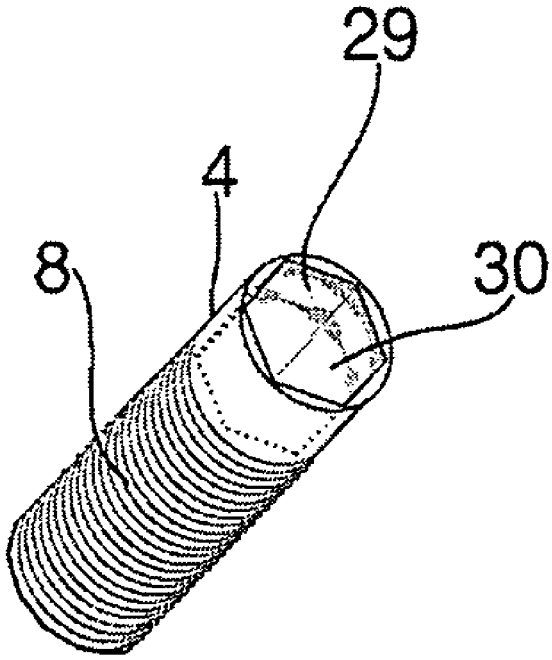
FIG. 1B is an enlarged, perspective view of the top portion of drive screw (4) shown in FIG. 1 illustrating hexagonal bore (29) disposed therewithin.
Figure 3:
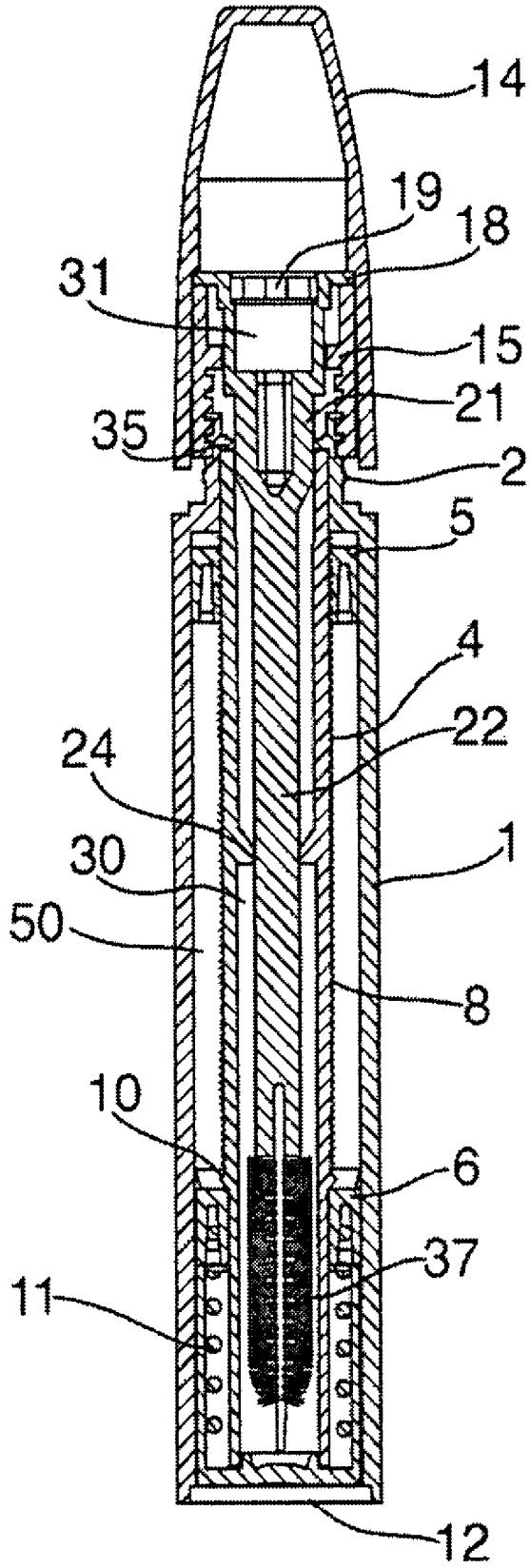
FIG. 3 is a cross sectional view of an assembly of the elements of FIGS. 1 and 2 taken along the vertical axis of the assembled device, in partially open orientation.

The upper end of the drive screw has a round external cross section which fits within the inside diameter of the container neck (2), as best shown in FIG. 3. The container has a small outward step or lip (35) within the neck (2), which functions as a stop for the drive screw (4), while permitting the screw to rotate about the container's central vertical axis. Within the upper end of the bore (30) of the drive screw, a shaped interior (29), shown to be hexagonal in FIG. 1B, is provided, defined herein as the drive in the drive screw bore that is adapted to receive a positive rotational drive from another component, which can be assembled within the cap. The drive (29) in the top of the drive screw bore is also referred to herein as the complementary drive (29).

A preferably molded piston (5) is assembled to the drive screw (4) and is engaged with the external threads (8) of the drive screw (4). The piston (5) has a threaded interior bore (24), which engages the drive screw threads (8). The flexible piston (5) fits within the inside diameter of the container (1) with a designed interference fit that creates a peripheral seal. Assembled at the lower end of the drive screw (4) is a cylindrically shaped valve (6), which also fits within the inside diameter of the container (1) with a designed interference fit to create a peripheral seal. The valve (6), shown in greater detail in FIG. 1A, has a smooth bore central portion (42) that fits closely around the base of the drive screw (4) in the non-threaded portion (7) of the drive screw (4). The fit allows the valve (6) to move axially about the drive screw (4). The valve is also free to move rotationally on the portion (7) of the drive screw. The bore (42) of the valve (6) has a conical seal or beveled surface (9) which mates with a conical valve seat or beveled surface (10) around the diameter of the drive screw (4) at the upper end of the non-threaded portion (7). The valve seat (10) preferably is a radial extension on the drive screw (4) whose diameter is greater than the diameter of the drive screw (4).

A biasing element, such as compression spring (11), is fitted behind the valve (6) and is seated within a recess in the base of the valve. Although a compression spring is preferred, any biasing element can be used; for example an elastomeric material having a memory. An end cap (12) fits inside the open end (25) of the container (1) and, as shown in FIG. 3, the biasing element (11) fits within the inside diameter of the end cap (12). The end cap (12) has a sufficient interference fit with the container (1) to create a seal as well as continually compress the spring (11) between the interior of the end cap (12) and the valve (6). The end cap (12) also functions to create a solid mechanical end for the container (1) in addition to performing the function of an axle for the bottom end of the drive screw (4).

The biasing element (11), which is fitted and compressed between the valve (6) and the end cap (12), keeps the conical valve seal (9) tight against the conical valve seat (10) on the drive screw (4). Below the conical valve seat (10) on the drive screw (4) and towards the end cap (12), are a plurality of apertures (13) (preferably two or three), which are radially and equally distributed about the diameter of the drive screw (4). The apertures (13) extend through the wall of the drive screw and are preferably holes 0.060" in diameter. The diameter of the holes is adjusted depending upon the viscosity and flow characteristics of the composition that is to be housed in the device.

Figure 2:
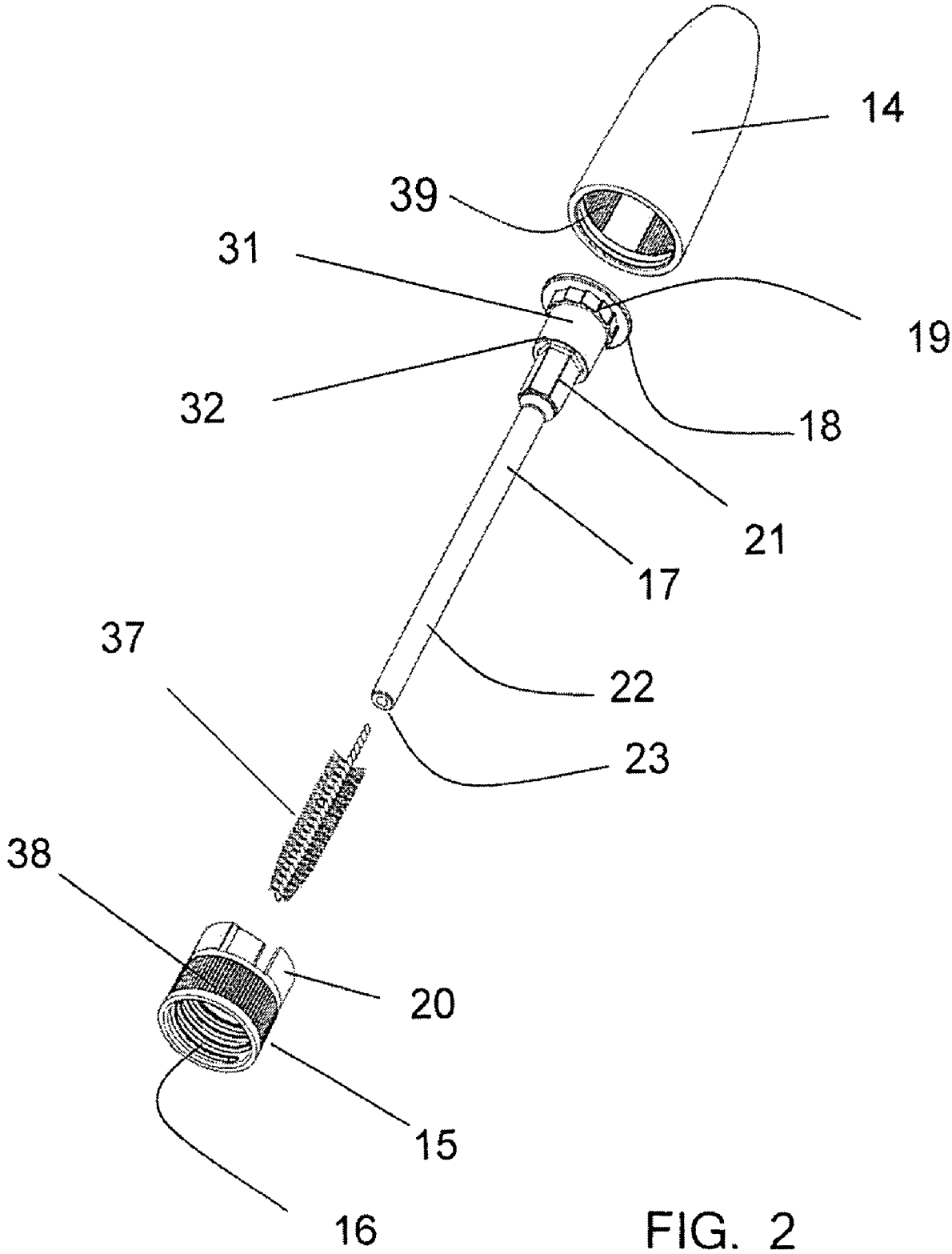
FIG. 2 is an exploded perspective view of the cap, applicator rod, brush, and cap insert employed (with the elements of FIG. 1) in a preferred embodiment of the assembled device of the invention.
Figure 4:
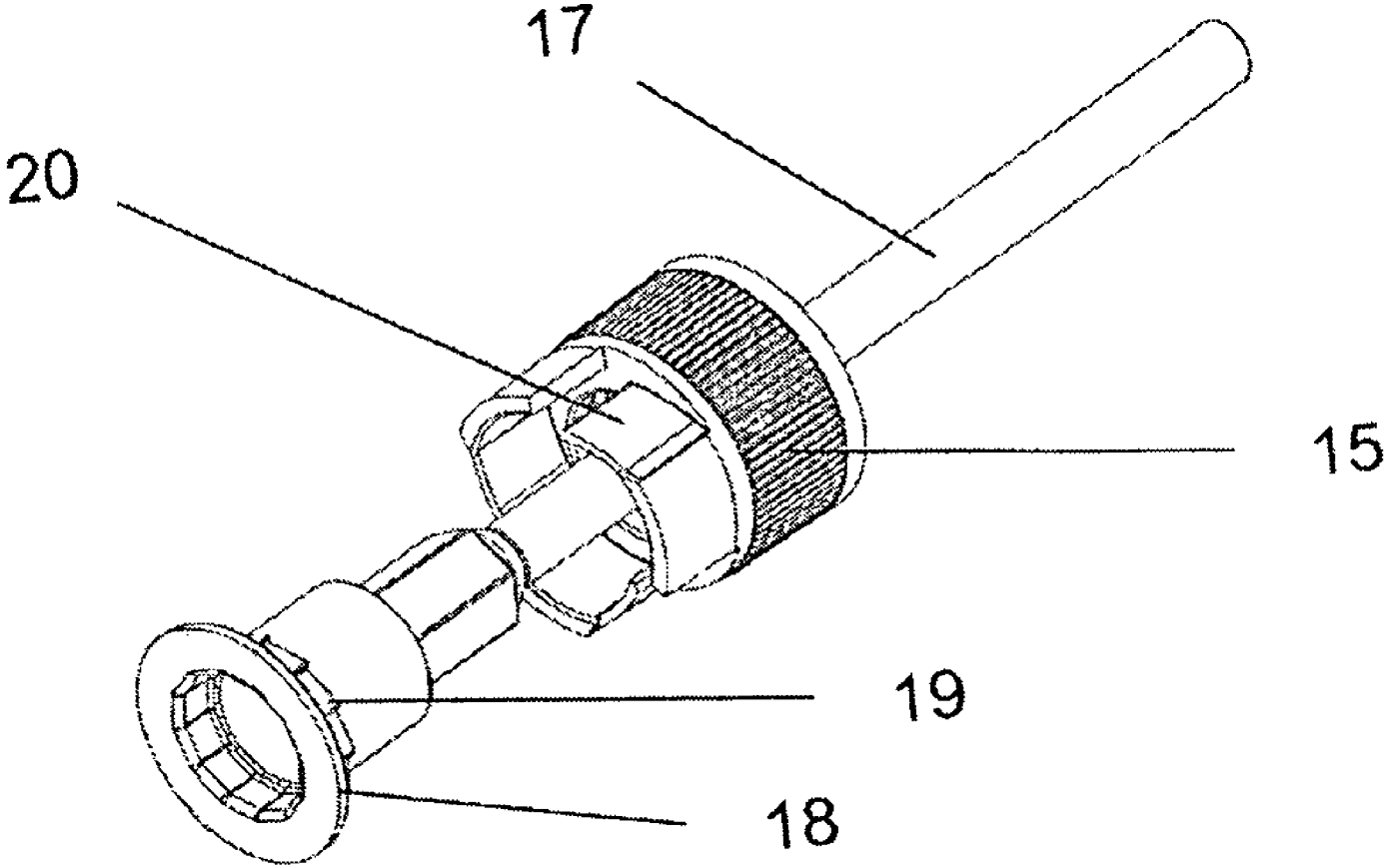
FIG. 4 is a perspective view showing cooperation of the tabs on the cap insert with ratchet teeth on the head of the applicator rod.

As shown in FIG. 2, the cap (14) is molded and shaped to match the container (1) outside diameter and has a series of internal splines (39) and an undercut bead that engage splines (38) provided along the lower periphery of threaded cap insert (15) to create an interference fit. The cap insert (15) has internal threads (16), which engage the external threads of the container neck (2). An applicator rod (17) that is preferably round in cross section and has an upper flange (18), a cylindrical upper section (31), and a preferably hexagonal section (21) is fitted into and through the cap insert (15). Hexagonal section (21) is herein defined as the cap drive and is complementary to the drive in the hexagonal bore (29) of the drive screw. When engaged, rotational motion from the applicator rod (17) is transferred to the drive screw (4). The resultant assembly is fitted into the cap (14) so that the rod flange (18) is trapped between the cap (14) and cap insert (15) and is free to rotate but not move axially. As is more clearly shown in FIG. 4, about the axis of the upper end of the rod (17), but between the flange (18) and the cylindrical upper section (31), are at least one, preferably a series of outward ratchet teeth (19), which correspond with at least one, preferably a plurality, of angularly offset flex tabs (20) (preferably two to three tabs) on the upper end of the cap insert (15). The ratchet system is designed to drive the rod (17) in one direction and free wheel in the other direction. Preferably the ratchet engages when the cap assembly is rotated counterclockwise and free wheels or ratchets when the cap assembly is rotated clockwise. Lower end of the cylindrical section (31) has a lip (32) that creates a seal on the top of lip (35) of the open end (3) of the neck (2) of the container (1). The rod (17) also has an extension comprising a long slender shaft (22) having an orifice (23) at its lower end for insertion of an applicator (37), for example, a mascara brush. The shaft (22) and applicator (37) are designed to fit inside the internal bore of the drive screw (4).

In assembly, the piston (5) is threaded onto the drive screw (4) and positioned at the top end of the threaded portion (8) of the drive screw (4). The drive screw/piston assembly is inserted into the container (1) housing through its open end (25) so that the upper end of the drive screw (4) is fitted within the inside diameter of the container neck. The cap assembly of FIG. 2 (rod (17) with applicator (37), cap insert (15), and cap (14)) is screwed clockwise onto the threaded neck portion (2) of the container (1). The container/cap assembly is turned upside down to enable the cosmetic composition to be filled into the container through the open lower end (25) of the container such that the composition resides in the annular compartment between the outside diameter of the drive screw (4) and the internal diameter of the container (1) and from the base of the piston (5) up to the conical valve seat (10) on the drive screw (4). The valve (6) is then assembled onto the drive screw (4). As previously mentioned, the valve (6) and the piston (5) each provide a tight interference fit with the inside wall of the container (1), and accordingly seal the composition within the annular compartment. The biasing element (11) and end cap (12) are then placed into the container, to complete the assembly of the device. The end cap (12) is pushed into the container, up to a stop inside the container.

Figure 5A:
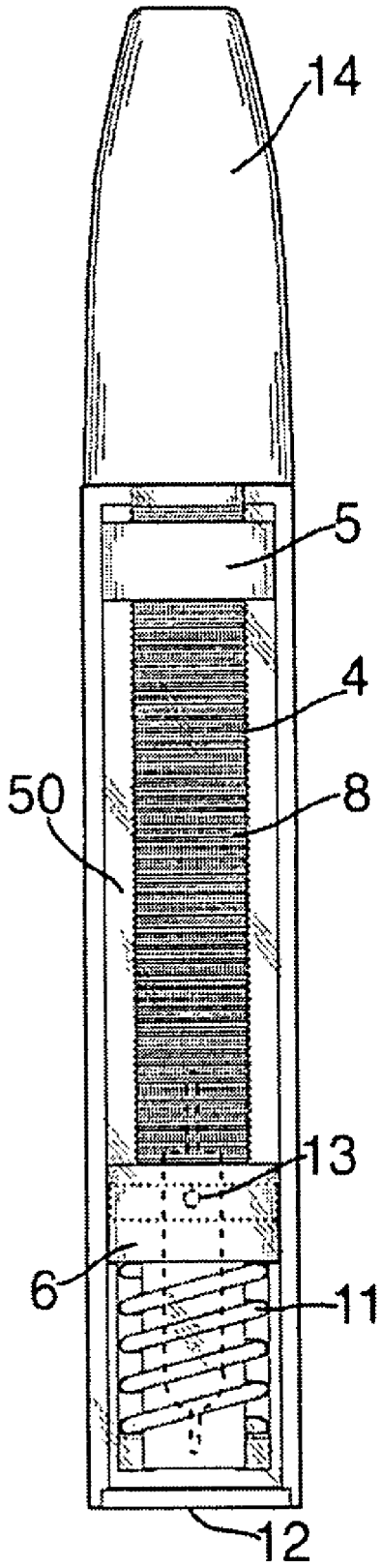
FIG. 5A illustrates the dispenser with the cap in closed position.

The assembled dispenser is shown in its initial closed position in FIG. 5A. In this closed position the piston (5) is shown at the top of the threaded portion (8) of the drive screw (4). Similarly, the valve (6) is seated against the valve seat (10), and the valve (6) covers the aperture (13). Accordingly, composition is contained in annular compartment (50).

Figure 5B:
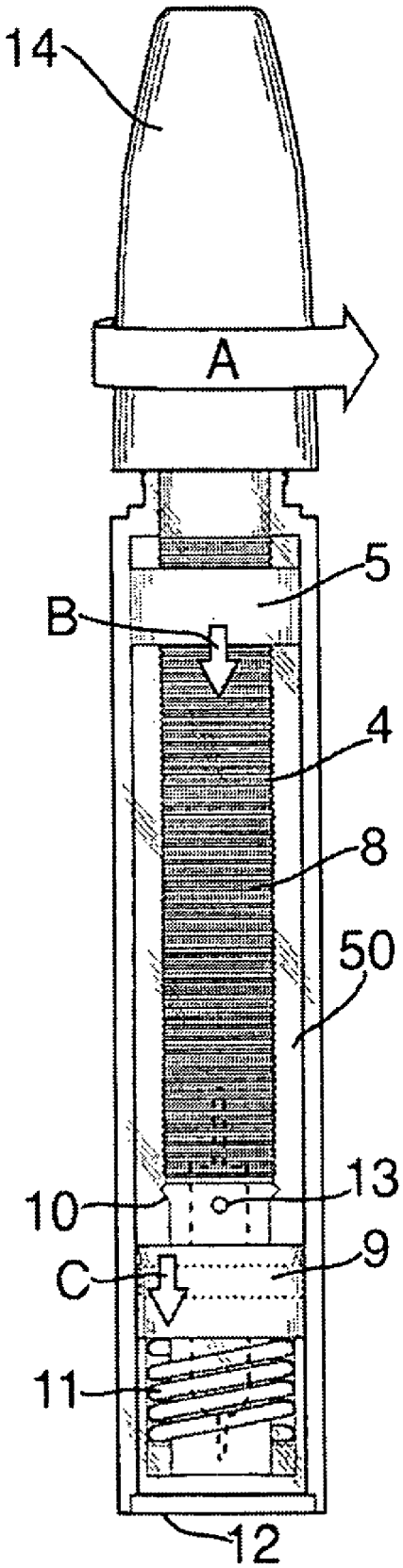
FIG. 5B illustrates the dispenser as the cap is being opened by rotating the cap, causing its upward advance away from the cylindrical container.

When the end-user unscrews the cap (14) to open the dispenser (shown by the counterclockwise arrow A in FIG. 5B), the tabs (20) on the cap insert (15) engage the ratchet teeth (19) on the rod (17), and cap rotational motion is transferred to the rod (17) as the cap (14) is unscrewed from the container neck (2). The cap drive, e.g., the hexagonal male section (21) of the rod (17), with which the complementary drive (29) within the bore (30) of the drive screw (4), e.g., the female end of the drive screw, is cooperatively engaged before and while the cap (14) is being unscrewed from the dispensing device, transfers rotational motion from the rod (17) to the drive screw (4). As the drive screw (4) is rotated about its fixed axis, the piston (5) is driven downward (arrow B in FIG. 5B) in an unscrewing manner towards the valve (6), reducing the volume of the annular compartment (50) and increasing the pressure on the composition in the annular compartment. In response to this increase in pressure, the valve (6) moves in the direction of the biasing element, spring (11), further compressing the biasing element (arrow C in FIG. 5B). As the conical valve seal (9) moves away from the conical valve seat (10), the composition flows through the apertures (13) in the side of the drive screw (4) and enters the interior chamber (bore (30)) of the drive screw (4), where the applicator is housed in its rest position. As a dose of composition flows through the apertures into the chamber, the pressure in the annular compartment (50) is reduced, allowing the compressed biasing element (11) to elongate and move the valve (6) back to its rest position against the conical valve seat (10), thus closing the system. At this time, the cap threads (16) have been unscrewed from the container (optimally, approximately two full rotations) and the cap (14) is disengaged from the container neck threads (2). As the cap (14) is pulled axially away from the container, the hexagonal rod shaft (21) is also disengaged from the complementary drive (29) in the bore (30) of the drive screw (4), and the applicator (37) axially travels the full interior length of the drive screw (4). Preferably the applicator (37) interferes with an optionally provided wiper area, preferably comprising a reduced orifice (24), situated in communication with the drive screw (4). This action allows the single dose of composition to be evenly distributed over the length of the applicator (37).

The end-user applies the composition, as required, then reinserts the applicator/cap assembly in the container/drive screw. As the threads of the cap, or more specifically of the cap insert, engage the container threads, the cap is turned in a clockwise direction to replace the cap on the unit. The hexagonal male section of the rod engages the drive screw but the cap insert tabs and rod ratchet system allow the rod to free wheel within the cap due to the inherent friction of the piston. The drive screw is not driven during cap replacement. The piston (5) remains stationary in the position to which it was advanced during the removal of the cap (14). The piston (5) will similarly advance downwardly with each subsequent use of one dispenser (i.e., removal of the cap), until the piston (5) is proximate the conical valve seal (9).

The components of the device of the present invention may be made of any number of materials, especially from molded plastic materials using conventional plastic molding methods appropriate for the selected material. The container (1), end cap (12) and cap (14) can be made of, but are not limited to, for example, polyester, polystyrene, nylon or high molecular weight polyolefin. Polyethylene terephthalate (PET) and poly (cyclohexylene dimethylene cyclohexanedicarboxylate) (PCTA), a copolyester of cyclohexane dimethanol (CHDM) and terephthalic acid (TA), are preferred, particularly when the device is to house a post-foaming composition. Preferably, the material or materials selected to fabricate the container (1), end cap (12) and cap (14) should allow for aesthetic consistency of the appearance of the assembled device. Most preferably, the material or materials should be such that it is possible for the end caps (12) and the container (1) to be ultrasonically sealed together.

The drive screw (4), cap insert (15) and rod (17) are preferably made of nylon, acetal, polyphenolyne sulfide (PPS), polyester sulphone, or polypropylene composite polymer. Acetal is preferred, particularly when the device is to house a post-foaming composition.

The piston (5) and valve (6) should preferably be made of a softer more resilient material such as certain grades of polyethylene, elastomeric polyester or polypropylene. Low density polyethylene (LDPE) is preferred, particularly when the device is to house a post-foaming composition.

Although the rod (17) can be employed for applying the composition housed in the device to the face, lips, skin, hair, etc., an accessory applicator can be employed. Examples of suitable accessory applicators include, but are not limited to: twisted wire brushes, molded brushes, foam pads, flocked tipped applicators, staked fiber brushes, combs and plastic spatulas.

The accessory applicator can be mounted on the rod, for example, by providing the accessory applicator with an extension that fits within the orifice (23) of the shaft (22) of the rod (17).

What is claimed is:

1. A dispensing device for a flowable composition comprising:

a tubular container;

a drive screw having an axial bore, the drive screw being disposed within the tubular container;

a cap for closing the container;

a first seal and a second seal on the drive screw, the first and second seals forming with the inner wall of the tubular container and the outer wall of the drive screw an annular compartment for containing the flowable composition;

at least one channel providing fluid communication between the annular compartment and the bore of the drive screw; and a drive associated with the cap and a complementary drive associated with the drive screw, the drives cooperatively decreasing the volume of the compartment each time the container is opened;

the second seal, normally closing the channel, opening the channel in response to the decrease in volume in the compartment and permitting composition to flow through the channel into the axial bore of the drive screw.

2. The device, as claimed in claim 1, wherein the annular compartment contains a flowable composition.

3. The device, as claimed in claim 2, wherein the flowable composition contains one or more volatile agents.

4. The device, as claimed in claim 3, wherein the mascara composition is a post-foaming mascara composition.

5. The device, as claimed in claim 1, wherein the annular compartment contains a lip gloss or lip gel composition.

6. The device, as claimed in claim 5, wherein the lip gloss or lip gel composition contains one or more volatile agents.

7. The device, as claimed in claim 6, wherein the lip gloss or lip gel composition is a post-foaming lip gloss or lip gel composition.

8. The device, as claimed in claim 1, further including an, to facilitate application of composition deposited thereon.

9. The device, as claimed in claim 1, further including an end cap in the container, at the bottom, for maintaining the drive screw axis vertical and for sealing the bottom of the bore of the drive screw while permitting rotation thereof.

10. The device, as claimed in claim 1, further including a wiper for removing excess composition from the applicator when it is removed from the container for purposes of applying the composition.

11. The device, as claimed in claim 10, wherein the wiper is a constriction in the bore of the drive screw.

12. The device, as claimed in claim 1 wherein the annular compartment contains a concealer or foundation composition.

13. The device, as claimed in claim 1, wherein the annular compartment contains a composition whose stability is decreased when exposed to normal atmospheric conditions.

14. The device, as claimed in claim 1, wherein the annular compartment contains a mascara, lip gloss, lip gel, concealer, foundation, eyebrow enhancer or eyeshadow composition.

15. A dispensing device for a cosmetic composition comprising:

a tubular container having a bottom end, a top end, an interior wall and an externally threaded neck at the top end, the container being open at the neck;

a drive screw having a top end, a bottom end, a vertically extending axial bore, an a threaded outer wall, the threading terminating at a point above the bottom end of the drive screw;

a drive within the bore proximate the top end of the drive screw;

a valve seat on the drive screw below the threaded outer wall, the wall of the drive screw below the valve seat having at least one aperture;

a piston threadably mounted on the drive screw;

a valve having a valve seal, the valve being mounted on the drive screw below the valve seat;

the drive screw with the piston and the valve mounted thereon being positioned within the tubular container, the piston and the valve each forming with the interior wall of the tubular container a frictional peripheral seal, the piston and the valve defining with the interior wall of the tubular container and the outer wall of the drive screw an annular compartment for the composition, the at least one aperture providing fluid communication between the annular compartment and the axial bore, the piston being rotatably movable downwards on the drive screw, and the valve being axially movable only in a direction downwards from the valve;

a biasing element for biasing the valve seal against the valve seat so that the at least one aperture in the wall of the drive screw is normally closed;

and a cap assembly comprising a cap; a rod mounted from the cap and being removably insertable in the axial bore, the rod having at least one ratchet tooth about its circumference and a drive adapted to complement the drive within the bore of the drive screw, the rod drive engaging the drive within the drive screw bore when the rod is within the bore of the drive screw; a cap insert mounted in the cap and having at one end internal threading that mates with the external threading on the neck of the tubular container and, at its other end, at least one angularly offset tab, the ratchet tooth on the rod engaging the angularly offset tab when the rod is turned in one direction and free wheeling when the rod is turned in a direction opposite to said one direction;

whereby, when the cap is threaded off the neck of the tubular container to open the container, the at least one ratchet tooth rotates about the longitudinal axis of the rod engaging the at least one tab and rotates the piston threading it downwards on the drive screw which increases pressure on the composition in the annular compartment which overcomes the upward biasing force of the biasing element and causes the valve seal to move downwards from the valve seat exposing the at least one aperture in the wall of the drive screw and permitting composition to flow from the annular compartment into the bore of the drive screw to contact the rod.

16. The device, as claimed in claim 15, further including an applicator mounted on the rod, to facilitate application of composition deposited thereon.

17. The device, as claimed in claim 15, further including an end cap in the container, at the bottom end, for maintaining the drive screw axis vertical and for sealing the bottom of the bore of the drive screw while permitting rotation thereof.

18. The device, as claimed in claim 15, further including a wiper for removing excess composition from the applicator when it is removed from the container for purposes of applying the composition.

19. The device, as claimed in claim 18, wherein the wiper is a constriction in the bore of the drive screw.

20. The device, as claimed in claim 15, wherein the annular compartment contains a flowable composition.

21. The device, as claimed in claim 20, wherein the flowable composition contains one or more volatile agents.

22. The device, as claimed in claim 21, wherein the flowable composition is a post-foaming mascara composition.

23. The device, as claimed in claim 21, wherein the tubular container and cap are made of polyethylene terephtalate (PET) or poly(cyclohexylene dimethylene cyclohexanedicarboxylate) (PCTA); the drive screw and applicator are made of acetal; and the piston and the valve are made of low density polyethylene.

24. The device, as claimed in claim 15, wherein the annular reservoir contains a lip gloss or lip gel composition.

25. The device, as claimed in claim 24, wherein the lip gloss or lip gel composition contains one or more volatile agents.

26. The device, as claimed in claim 25, wherein the lip gloss or lip gel composition is a post-foaming lip gloss or gel composition.

27. The device, as claimed in claim 15, wherein the annular compartment contains a mascara, lip gloss, lip gel, concealer, foundation, eyebrow enhancer or eyeshadow composition.

28. The device, as claimed in claim 15, wherein the tubular container and cap are made of polyethylene terephtalate (PET) or poly(cyclohexylene dimethylene cyclohexanedicarboxylate) (PCTA); the drive screw and applicator are made of acetal; and the first seal and the second seal are made of low density polyethylene.

* * * * *